US009309025B2

(12) United States Patent
Luis y Prado

(10) Patent No.: US 9,309,025 B2
(45) Date of Patent: Apr. 12, 2016

(54) SECURING LOADS TO PALLETS

(71) Applicant: Workshops for Warriors, San Diego, CA (US)

(72) Inventor: Hernán Luis y Prado, San Diego, CA (US)

(73) Assignee: Workshops for Warriors, San Diego, CA (US)

( * ) Notice: Subject to any disclaimer, the term of this patent is extended or adjusted under 35 U.S.C. 154(b) by 0 days.

(21) Appl. No.: 14/559,463

(22) Filed: Dec. 3, 2014

(65) Prior Publication Data

US 2015/0151873 A1 Jun. 4, 2015

Related U.S. Application Data

(60) Provisional application No. 61/911,377, filed on Dec. 3, 2013.

(51) Int. Cl.
*B65D 19/38* (2006.01)
*B65D 19/44* (2006.01)
*B65D 19/00* (2006.01)

(52) U.S. Cl.
CPC ..... *B65D 19/44* (2013.01); *B65D 19/0012* (2013.01); *B65D 2519/00019* (2013.01); *B65D 2519/00024* (2013.01); *B65D 2519/00029* (2013.01); *B65D 2519/00034* (2013.01); *B65D 2519/00054* (2013.01); *B65D 2519/00059* (2013.01); *B65D 2519/00064* (2013.01);
(Continued)

(58) Field of Classification Search
CPC ..... B65D 19/44; B65D 19/00308; B65D 19/00363; B65D 19/00004; B65D 2519/00288; B65D 2519/00034; B65D 2519/00069; B65D 2519/00363; B65D 2519/00308
USPC ..... 108/55.3, 55.5, 51.11, 57.25, 57.33
See application file for complete search history.

(56) References Cited

U.S. PATENT DOCUMENTS 2,696,360 A * 12/1954 Toffolon ..... 206/597
3,472,363 A * 10/1969 Overton et al. ..... 206/597
(Continued)

OTHER PUBLICATIONS

Authorized Officer L. Tsoban, Notification of Transmittal of the International Search Report and the Written Opinion of the International Searching Authority, International Application No. PCT/US2013/050900, mailed Nov. 21, 2013, 6 pages.
(Continued)

*Primary Examiner* — Jose V Chen
(74) *Attorney, Agent, or Firm* — Fish & Richardson P.C.

(57) ABSTRACT

A pallet, a method of securing a load to a pallet, and a method of manufacturing therefor, in which the pallet includes a top plate defining a first surface area, a base structure defining a second surface area that is less than the first surface area, and support legs, at least a portion of which join the top plate and the base structure. The support legs are disposed between the top plate and the base structure in an arrangement that accommodates engagement of the pallet with a standard jacking device along any edge of the pallet. Securing slots extend through the top plate, wherein a first subset of the securing slots is oriented lengthwise parallel to a first edge of the top plate and a second subset of the securing slots is oriented lengthwise perpendicular to the first edge of the top plate. A pair of edges of the top plate extend beyond a pair of edges of the base structure that are parallel to the pair of edges of the top plate to further facilitate engagement of the pallet with a lifting mechanism.

19 Claims, 7 Drawing Sheets

(52) U.S. Cl.
CPC ..... *B65D2519/00069* (2013.01); *B65D 2519/00089* (2013.01); *B65D 2519/00094* (2013.01); *B65D 2519/00099* (2013.01); *B65D 2519/00104* (2013.01); *B65D 2519/00273* (2013.01); *B65D 2519/00283* (2013.01); *B65D 2519/00308* (2013.01); *B65D 2519/00318* (2013.01); *B65D 2519/00348* (2013.01); *B65D 2519/00373* (2013.01); *B65D 2519/00815* (2013.01); *Y10T 29/49895* (2015.01)

(56) References Cited

U.S. PATENT DOCUMENTS

| | | | | |
|---|---|---|---|---|
| 3,606,844 | A | 9/1971 | Lubker | |
| 4,614,277 | A | 9/1986 | Fourie | |
| 4,829,909 | A | 5/1989 | Mandel | |
| 4,890,560 | A | 1/1990 | Good | |
| 5,020,667 | A * | 6/1991 | Bush | 206/386 |
| 5,258,137 | A | 11/1993 | Bonekamp | |
| 5,413,052 | A * | 5/1995 | Breezer et al. | 108/56.1 |
| 5,720,229 | A * | 2/1998 | Schrage | 108/55.5 |
| 6,065,916 | A | 5/2000 | Swensen | |
| 6,101,955 | A * | 8/2000 | Salce | 108/51.11 |
| 6,123,208 | A * | 9/2000 | Haenszel | 211/175 |
| 6,199,488 | B1 * | 3/2001 | Favaron et al. | 108/57.25 |
| 6,234,087 | B1 | 5/2001 | Brown | |
| 6,283,044 | B1 | 9/2001 | Apps | |
| 6,298,999 | B1 * | 10/2001 | Bellman | 211/24 |
| 6,422,795 | B2 | 7/2002 | Holt | |
| 6,524,040 | B1 * | 2/2003 | Heil | 410/67 |
| 6,622,642 | B2 * | 9/2003 | Ohanesian | 108/57.25 |
| 6,712,567 | B2 * | 3/2004 | Hsu | 410/46 |
| 6,807,910 | B2 * | 10/2004 | Apps | 108/57.25 |
| 6,840,181 | B2 * | 1/2005 | Smyers | 108/56.1 |
| 6,905,021 | B2 | 6/2005 | Polumbaum | |
| 6,986,309 | B2 * | 1/2006 | Sugihara et al. | 108/57.25 |
| 7,007,613 | B2 * | 3/2006 | Sketo | 108/51.3 |
| 7,555,879 | B1 | 7/2009 | Utz | |
| 7,841,281 | B2 * | 11/2010 | Valentinsson | 108/57.25 |
| 7,987,796 | B2 * | 8/2011 | Nordstrom et al. | 108/53.3 |
| 8,256,615 | B2 * | 9/2012 | Goda | 206/386 |
| 8,256,621 | B2 * | 9/2012 | Deiger et al. | 206/600 |
| 8,336,465 | B2 * | 12/2012 | Poulsen et al. | 108/55.1 |
| 8,522,694 | B2 * | 9/2013 | Linares | 108/57.25 |
| 8,875,638 | B2 * | 11/2014 | Luis y Prado | 108/55.5 |
| 2003/0075082 | A1 | 4/2003 | Apps | |
| 2008/0295748 | A1 * | 12/2008 | Yoshida et al. | 108/55.1 |
| 2009/0090281 | A1 | 4/2009 | Huettner | |
| 2009/0146355 | A1 * | 6/2009 | Harvilchuck et al. | 269/91 |
| 2014/0133952 | A1 * | 5/2014 | Carling et al. | 414/800 |

OTHER PUBLICATIONS

Final Office Action, U.S. Appl. No. 13/944,690 dated May 28, 2014, 7 pages.

Office Action, U.S. Appl. No. 13/944,690 dated Feb. 14, 2014, 16 pages.

* cited by examiner

SECURING LOADS TO PALLETS

CROSS REFERENCE TO RELATED APPLICATIONS

This application claims the benefit under 35 U.S.C. §119 (e)(1) of U.S. Provisional Patent Application No. 61/911,377, filed on Dec. 3, 2013, which is incorporated by reference herein.

TECHNICAL FIELD

This specification relates to pallets, such as pallets used in the transport and storage of industrial equipment, supplies, or the like.

BACKGROUND

Also sometimes referred to as a "skid," a pallet is a flat transport structure that supports a load in a stable fashion while being lifted by a forklift, pallet jack, front loader or other jacking device. In general, a pallet is the structural foundation of a unit load, which allows handling, usage, and storage efficiencies. A load placed on a pallet often is secured to the pallet with straps, stretch wrap, or shrink wrap. Most pallets are wooden, but depending on the application, a pallet can be constructed of other materials such as plastic, metal, or paper, each material having advantages and disadvantages relative to the others.

Certain loads (e.g., large precision instruments, weaponry, ammunition, multiple payloads on one pallet, or industrial machinery), may be very heavy, unbalanced, delicate, and/or awkward. Consequently, such loads are typically rigged with wooden blocking, dunnage, and straps. These techniques are costly, time-intensive, and rely on operator skill to be performed safely and repeatedly. A successful palletization results in a load being secured to the pallet in a manner that prevents any substantial relative movement between the load and the pallet (in view of the load's delicacy).

SUMMARY

This specification describes a pallet system, sometimes referred to herein as a SMISS (Secure Material Integrated Storage System), defining securing slots of varying orientation, a method of securing a load to the pallet system, and a method of manufacturing therefor, that can be used, among other purposes, to securely hold and support industrial equipment during storage, during use, and in transport.

Particular implementations of the subject matter described in this specification may be configured to realize one or more or none of various potential advantages. For example, by constructing a pallet having securing slots of varying orientation (e.g., some securing slots that are parallel to one of the pallet's edges and other slots that are perpendicular to that same edge or combinations of them), loads can be secured with an appropriate securing mechanism (e.g., straps, bolts, or otherwise) to the pallet in a more convenient and secure manner. In addition, by disposing multiple varying orientated slots across the load bearing surface of the pallet, loads of many different sizes and shapes—including loads of irregular shapes or sizes—can easily and conveniently be accommodated, e.g., securely fastened to the pallet. Another potential advantage is that several payloads can be attached to a pallet as the slot configuration allows them to each be secured independent of the other load, whereas a conventional pallet would tend to squeeze all material together, potentially damaging the material that is to be secured.

Another potential advantage of the SMISS slot system is that bolts can be used to secure a variety of different loads without having to spend time and energy drilling holes. The securing slots allow the use of bolts to secure equipment securely and repeatedly to the pallet for transportation and use. For example, a bandsaw can be securely attached to the SMISS and can more easily be moved around a shop or production environment while still being stable enough to be used.

Parallel edges of the top plate can be extended to span beyond a width of the base structure. Doing so can enable coupling a lifting mechanism, e.g., spreader bars, forklift prongs, or other lifting mechanism, implemented by lifting machines, e.g., cranes, forklifts, or other lifting machines, to lift the pallet. The extended span of the top plate can increase a security of the pallet as it is being lifted. The parallel edges can be extended either length-wise or width-wise or both.

Details of one or more implementations of the subject matter described in this specification are set forth in the accompanying drawings and the description below. Other features, aspects, and potential advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
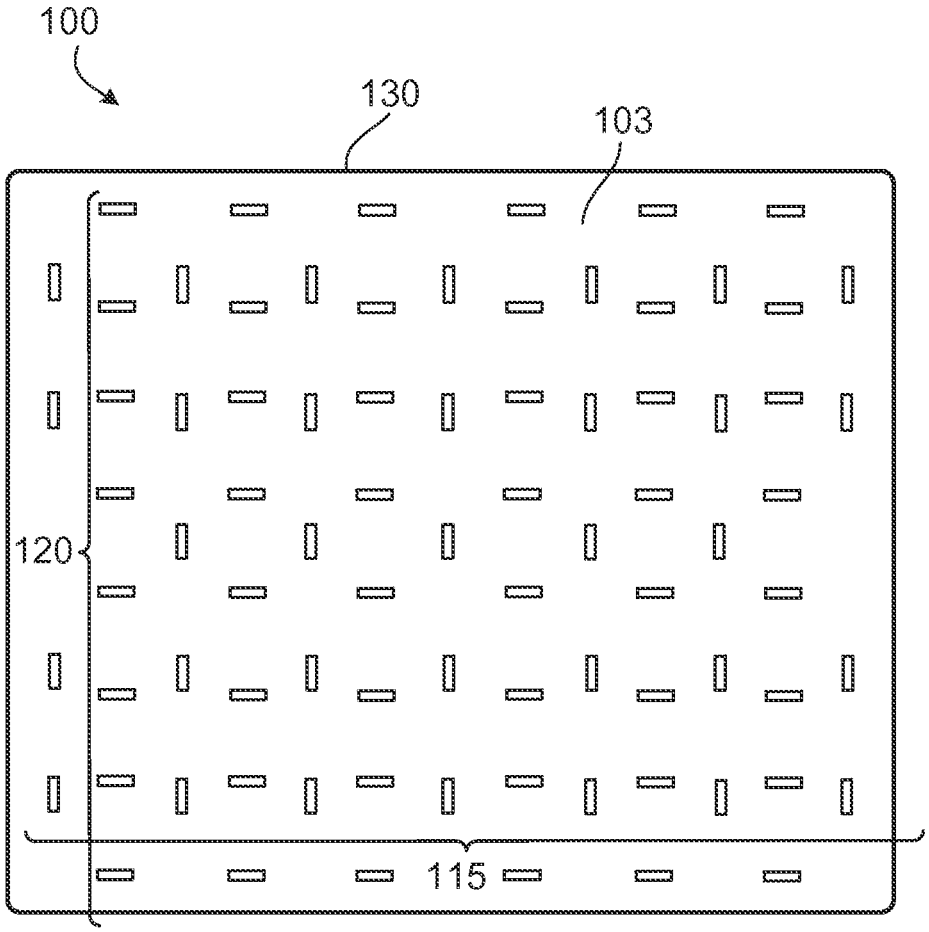
FIG. 1 is top view of a first implementation of a pallet.

FIG. 1 is a top view of a pallet 100. The pallet 100 includes a rectangular top plate 103 which as shown is 40 inches in one dimension and 48 inches in the other dimension. Either or both of the top plate 103 and a cross-sectional area of the pallet 103 may take on other shapes (e.g., square, round or triangular) and/or sizes depending on the desired application. For example, in other implementations, the top plate 103 can have approximate dimensions of 48 inches by 48 inches, 60 inches by 36 inches, 36 inches by 36 inches, or 24 inches by 24 inches. As shown in this example, the top plate 103 has eighty securing slots 105, each of which has a length dimension (e.g., about 2 inches) that is greater than a width dimension (e.g., about 0.5 inches). In general, the securing slots 105 are appropriately sized and shaped to receive and appropriately accommodate mechanisms that may be used to secure a load to the pallet 100—for example, either or both of securing bolts and/or the majority of metal and plastic strapping and banding material known to those skilled in the art can be used (½", ⅝" ¾" 1", 1¼", 1½" and 2" thick). As shown, the slots 105 are arranged in orientations that vary from each other, for example, a first subset of 48 slots is oriented such that each slot's lengthwise direction is perpendicular to an orientation of a second subset of 32 slots. More specifically, in this example, the top plate 103 has eight rows 120 of securing slots 105 (six slots 105 in each row 120, each row 120 being 5 inches apart from a consecutive row 120) arranged such that the slots 105 in each row 120 are lengthwise parallel to an edge 130 of the top plate 103 of the pallet 100. In addition, the top plate 103 has seven columns 115 of securing slots 105 (four slots 105 in some columns 115, five slots 105 in other columns 115, each column 115 being 5 inches apart from a consecutive column 115) arranged such that the slots 105 in each column 115 are lengthwise perpendicular to the edge 130 of the top plate 103. As a result, the columns 115 of slots 105 are perpendicular to the rows 120 of slots 105.

The above-described arrangement provides several potential advantages. For example, because the securing slots 105 on the top plate 103 (to which the load is affixed) are disposed in orientations that vary from one another (e.g., perpendicular to each other), a mechanical advantage arises that ensures that, when straps are secured through the slots 105 of varying orientation across a load, the load so secured will be held in a manner that substantially prevents relative movement between the load and the pallet 100. In addition, due to the relatively large quantity of securing slots 105 dispersed across the top plate 103, loads of various shapes and sizes—even loads of irregular shapes and sizes—may be quickly, easily, and conveniently positioned on the pallet 103 in a manner such that multiple available securing slots 105 are likely to be adjacent to the perimeter of the load and thus may be used to secure the load to the pallet 100. In contrast, with conventional pallets, the securing slots typically are oriented in only a single direction, which tends to make properly securing loads difficult if not impossible. Furthermore, the large quantity of securing slots 105 allows the top plate 103 of the pallet 100 to be partitioned, such that multiple payloads can be segregated from one another while being secured to the pallet 100. Such segregation may allow one payload to be secured to or removed from the pallet 100 without disturbing other payloads that are secured to the pallet 100.

Although the example of FIG. 1 shows a certain number of slots 105 of a certain size and shape disposed in a certain pattern, essentially any other number of slots, size, shape and pattern may be used depending on a desired application. The materials used to construct pallet 100 can be one or more of any materials appropriate for the load to be supported and transported, e.g., wood, metal, plastic, paper, ceramic, a non-flamable material, and/or other materials. In some examples, the pallet 100 is adapted to support a load of up to 25 tons. Such a load rating can allow the pallet 100 to support heavy equipment such as machinery and ammunition.

Figure 2:
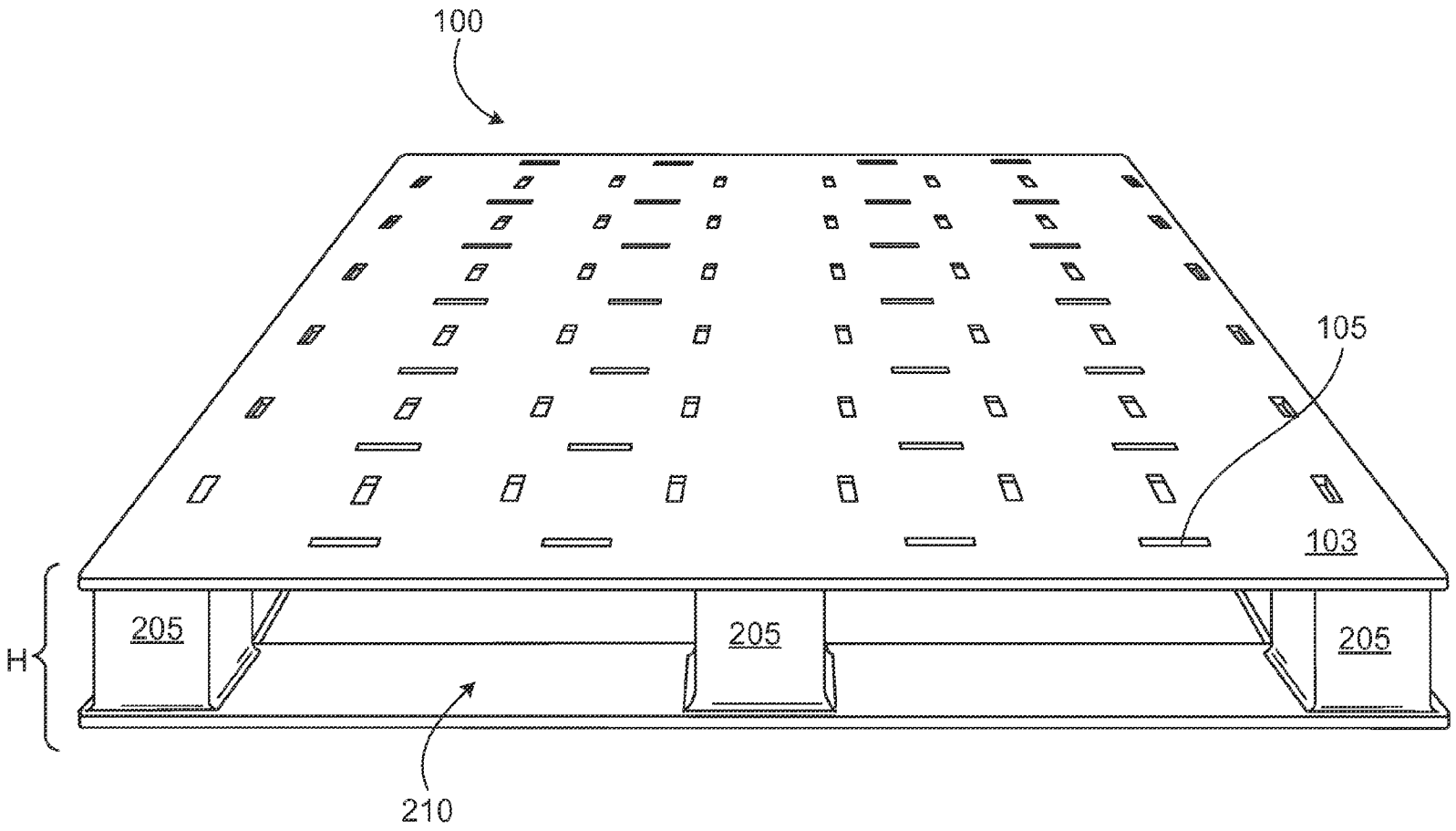
FIG. 2 is a perspective view of the pallet of FIG. 1.

FIG. 2 is a perspective view of the pallet 100. As shown, the pallet's top plate 103 is spaced apart from a base structure 210, which can either be a complete plate or, as shown, a plate having a central void (i.e., a hole in the middle of the plate, as shown in FIG. 4B). The top plate 103 is spaced apart from the base structure 210 by support legs 205, which are each attached to the top plate 103 at one end and attached to the base structure 210 at an opposite end. As shown, the support legs 205 can be formed as square posts or, alternatively, as posts of other shapes, such as cylindrical, rectangular, triangular, or the like. In this example, the pallet 100 includes eight peripheral support legs 205 (one in each corner of the pallet 100 and one at each mid-point of the edges,), although a different quantity of support legs 205 could be used as desired and/or appropriate. Additionally, the pallet 100 includes a center-point support leg 305 (shown in FIG. 3) that extends downward from the center of the top plate 103. In the example shown in FIG. 2, the height H of the palette is five (5) inches, which corresponds to a standard pallet height, but other heights could be used as desired/appropriate.

Figure 3:
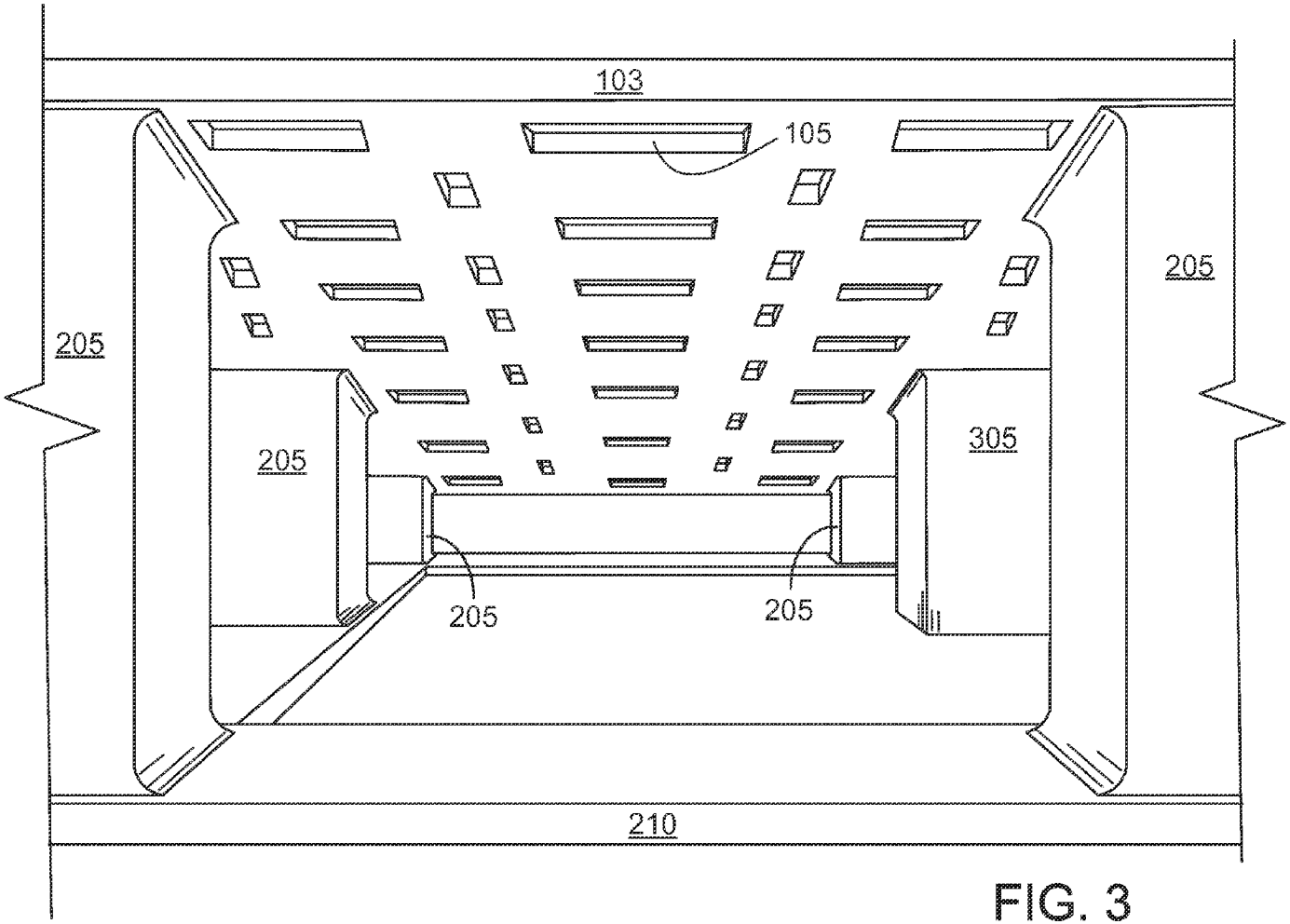
FIG. 3 is a perspective view of a portion of the pallet of FIG. 1, showing an internal structure of the pallet.

FIG. 3 is a perspective view of a portion of the pallet 100, and particularly, a view looking inside the pallet 100 such that the top plate 103 is at the top of the figure and the base structure 210 is at the bottom of the figure. As shown, several of the support legs 205 are visible. The center-point support leg 305 also is visible and from this view it becomes apparent that in this particular example, while joined to the top plate 103, the center-point support leg 305 is not joined to the base structure 210, but rather extends into the base structure's central void (i.e., hole in the middle of the base structure 210) and in fact contacts the ground surface when the pallet 100 is resting on the ground. Thus, the center-point support leg 305 is longer than the surrounding peripheral support legs 205 (e.g., by a length that is approximately equal to the thickness of the base structure 210).

Figure 4A:
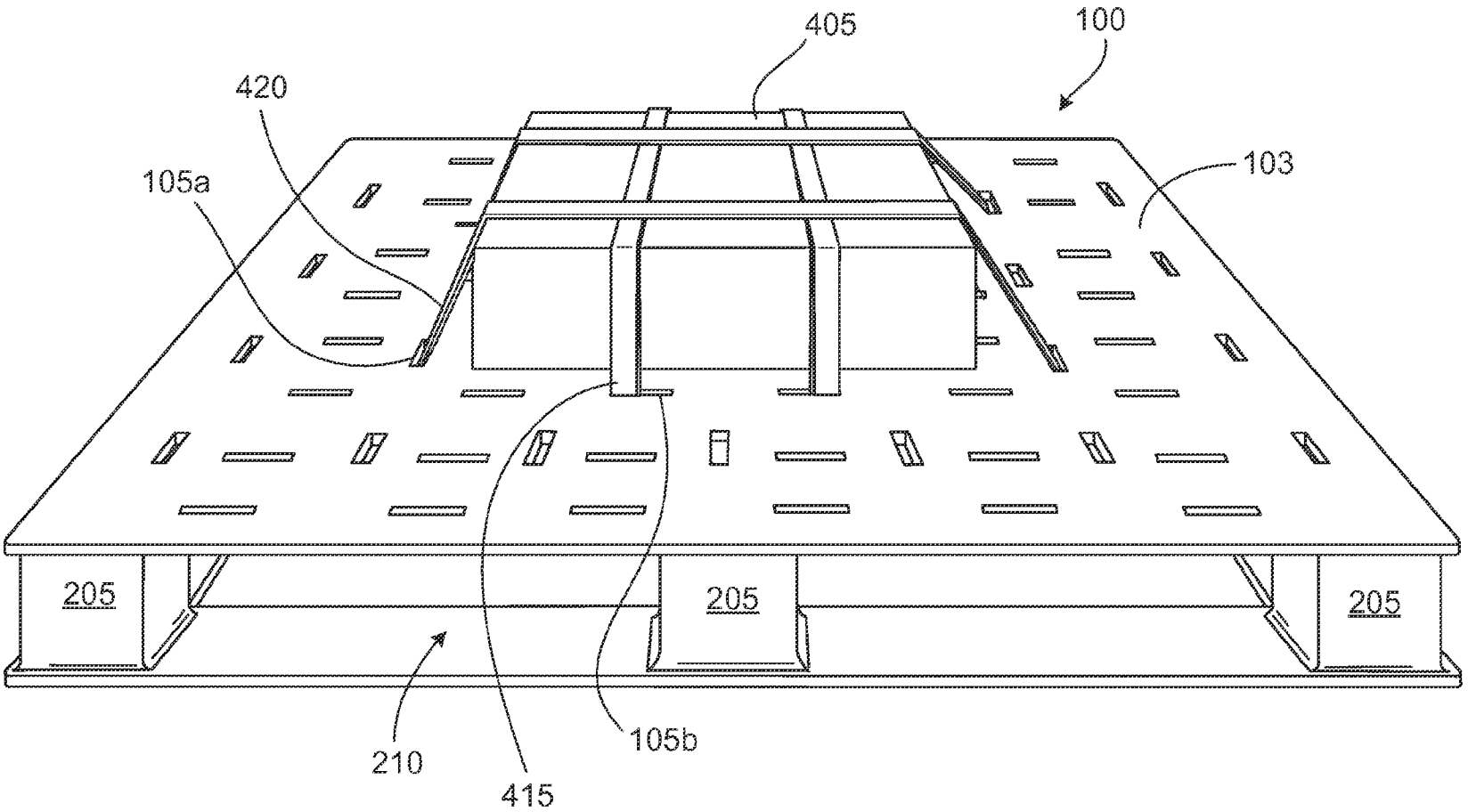
FIGS. 4A and 4B are perspective views of a load secured to the pallet of FIG. 1, as viewed from top and bottom surfaces, respectively, of the pallet.
Figure 4B:
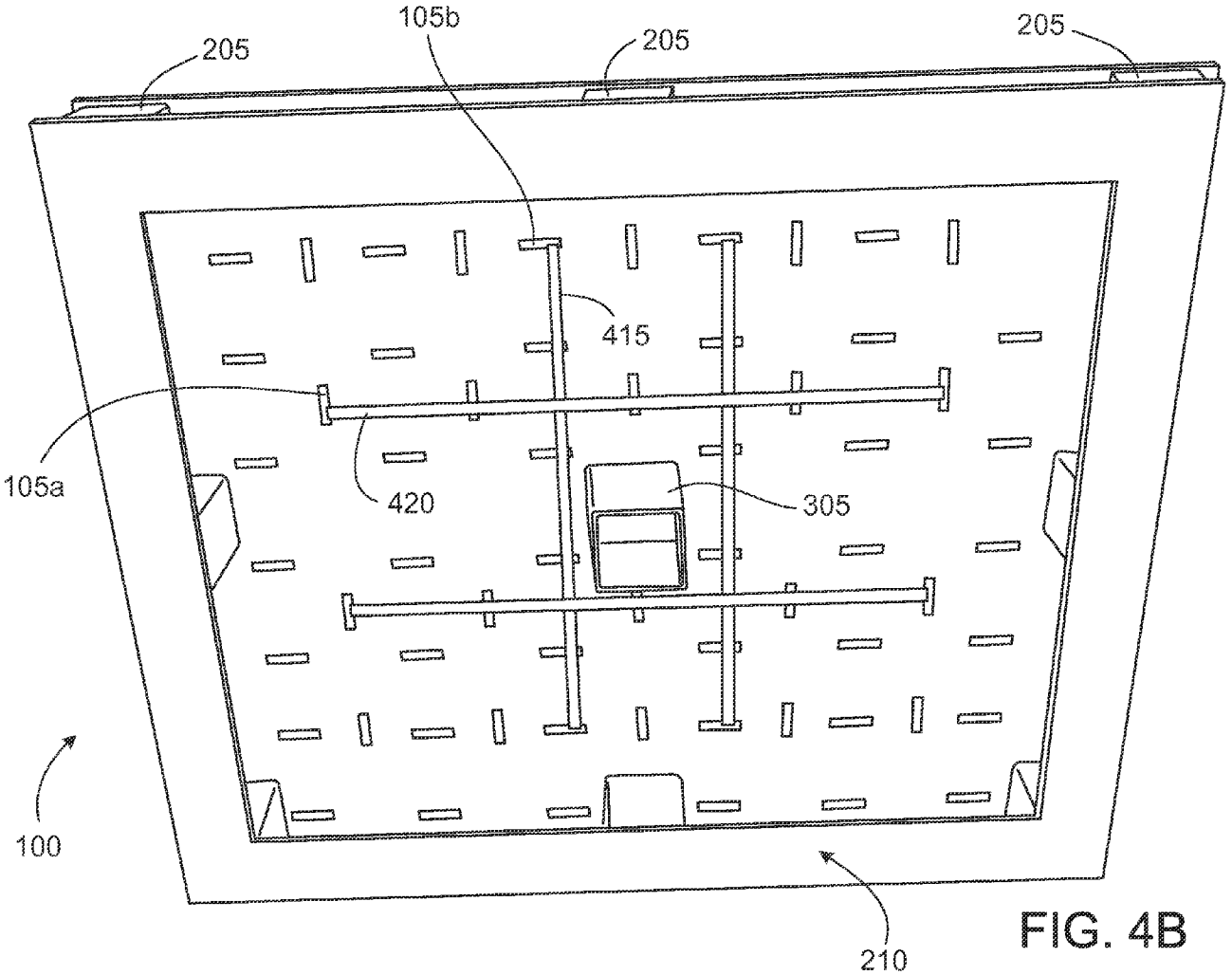

FIG. 4A is a perspective view of the pallet 100, to which a load 405 is secured. As shown, the load 405 sits on top of the top plate 103 and is secured to the pallet 100 by straps 415 and 420 (although bolts could be used instead of or in addition to straps 415 and 420). To better secure the load 405, straps 415 and 420 engage securing slots 105 that vary in orientation from each other, e.g., perpendicular to each other. More specifically, strap 420 engages a slot 105*a* and extends across the load 405 to secure load 405 to the pallet 100. At the same time, strap 415 engages slot a 105*b*, which is perpendicular to slot 105*a*. Because the two slots 105*a* and 105*b* vary in orientation, more particularly, because they are perpendicular to each other, the load 405 may be much more securely fastened to the pallet 100 than would otherwise be possible if the slots 105*a* and 105*b* had the same or similar orientation. As a result, the load 405 is much more likely to be secured to the pallet 100 in a manner that substantially resists any relative movement between the load 405 and the pallet 100. While the load 405 is shown as having a generally rectangular shaped cross-section, the pallet 100 may be used to support and secure loads having a variety of shapes. The straps 415 and 420 may be of the same construction or of a different construction. In some examples, a first end region of the strap 415 and 420 may be fastened to a second end region of the strap 415 and 420 via a hook and loop fastener mechanism disposed along the end regions of the strap 415 and 420.

FIG. 4B is a perspective view of the pallet 100 shown in FIG. 4A except that the pallet 100 in this view has been rotated to its side to expose the underside of the pallet 100. In this view, the slots 105*a* and 105*b* and straps 415 and 420 are visible.

Figure 5:
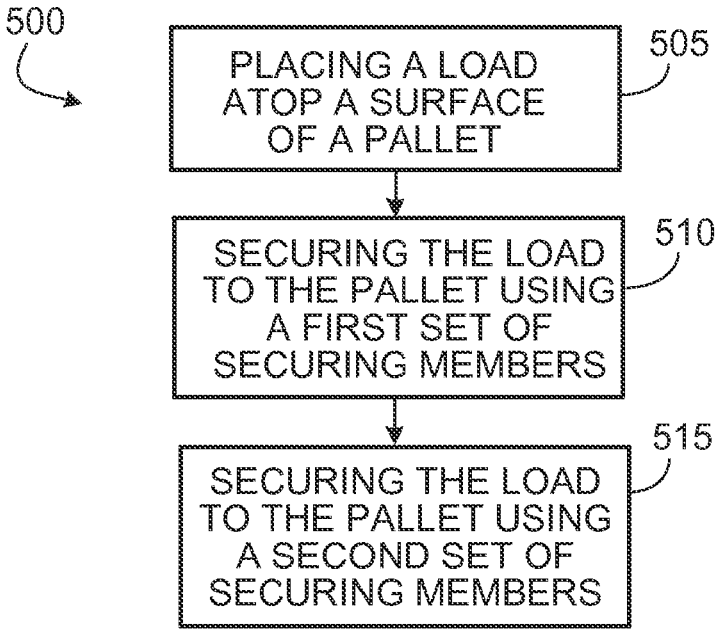
FIG. 5 is a flowchart of an example process for securing a load to a pallet.

FIG. 5 is a flowchart of an example process 500 for securing a load (e.g., the load 405) to a pallet (e.g., the pallet 100). Examples of such a load can include industrial equipment, supplies, large precision instruments, weaponry, and ammunition. At 505, the load is placed atop a surface (e.g., the top plate 103) of the pallet at a desired location. At 510, the load can then be secured to the pallet using a first set of one or more securing members (e.g., the straps 415 and 420). For example, a first set of one or more straps may be passed through a first set of respective slots (e.g., slots oriented lengthwise parallel to an edge of the pallet, such as the slot 105*a*) extending through a top plate of the pallet and then fastened securely around the load. At 515, the load may be further secured to the pallet using a second set of one or more securing members (e.g., the straps 415 and 420). For example, a second set of one or more straps may be passed through a second set of respective slots (e.g., slots oriented lengthwise perpendicular to the edge of the pallet, such as the slot 105*b*) extending through the top plate of the pallet and oriented perpendicular to the first set of slots and then fastened securely around the load. In this manner, the first set of one or more straps can extend across the load in a direction perpendicular to that at which the second set of one or more straps extends across the load. In some examples, the straps extend across the load with respect to each other at angles other than 90 degrees. In some cases, one or more additional loads may be secured to the pallet. In some examples, securing bolts can be used alternatively or in addition to the straps to secure the load to the pallet.

The SMISS pallet system described herein may include one or more other features/aspects. For example, the number of securing slots 105 as well as the number of rows 120 is something that can vary from one model of the SMISS to another model of the SMISS. The slots 105 are configured to accommodate strapping, banding, bolts, ratchet straps, or essentially any other suitable securing mechanism. The slots 105 can be different shapes (rectangular, circular, oval, square, star-shaped, t-slotted, etc.) to accommodate strapping, banding, bolts, ratchet straps, other proprietary fastening systems or essentially any other suitable securing mechanism. In some examples, two or more pallets 100 can be linked together to form a secure flooring for hazardous or uneven terrain. The pallet 100 can be made in a variety of heights, widths, and lengths to accommodate different payloads, storage racks, storage systems, and vehicles. The pallet 100 can be used to secure loads even upside down or during air and space transport. For example, a load can be secured to the pallet 100 while the pallet 100 is oriented right side up, and then the pallet 100 and the secured load may be lifted and turned upside down, sideways, or in an arbitrary direction during transport through the air. The pallet 100 is also reusable. The pallet 100 is environmentally friendly as the pallet 100 can be used thousands of times before the pallet 100 degrades or is damaged through use. The pallet 100 is easily repaired with commonly used tools and processes. The support legs 205, when welded or joined, are welded or joined by placing the pallet 100 in a welding fixture (or jig) that forces the pallet 100 to deform slightly so that when the support legs 205 are joined to the top plate 103 and the base structure 210, and the pallet 100 is removed from the welding jig, the support legs 205 are under some tension around the periphery, which allows for a stronger and more stable pallet 100. Due to the distribution of the support legs 205, the pallet 100 is accessible via forklift, pallet-jack, or skip loader from all four sides instead of from two sides like traditional pallets. For example, components of such support systems may be inserted underneath the top plate 103 of the pallet 100 and between two consecutive support legs 205 from any side of the pallet 100.

Figure 6:
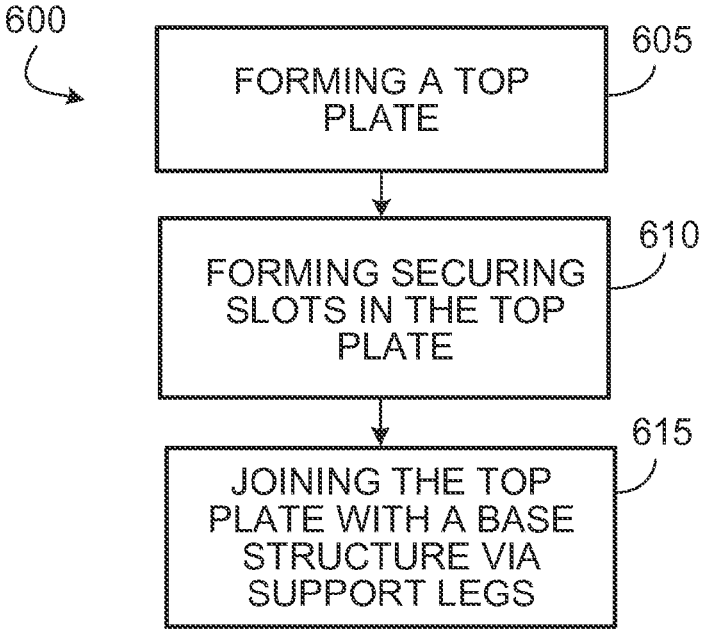
FIG. 6 is a flowchart of an example process for manufacturing a pallet.

FIG. 6 is a flowchart of an example process 600 for manufacturing a pallet (e.g., the pallet 100 as described above). The steps as shown in FIG. 6, and as further described below, need not necessarily be performed in the order indicated. In addition, in appropriate circumstances, two or more steps may be performed in an over-lapping or substantially simultaneous manner.

As shown in FIG. 6, first at 605, a top plate is formed from a plate of material (e.g., steel, aluminum, etc.) of rough dimension. Then, at 610, securing slots (e.g., the slots 105) are formed in the top plate such that a first subset of securing slots are formed to be lengthwise parallel to a first edge (e.g., the edge 130) of the top plate and a second subset of securing slots are formed to be lengthwise perpendicular to the first edge of the top plate. Next, at 615, the top plate with the securing slots formed therein is joined with a base structure (e.g., the base structure 210) via a plurality of support legs (e.g., the support legs 205 and the center-point support leg 305). The support legs are disposed between the top plate and the base structure in an arrangement that accommodates engagement of the pallet with a standard jacking device. For example, due to the distribution of the support legs, the pallet is accessible via the jacking device from all four sides instead of from two sides like traditional pallets.

In a specific implementation, the process 600 can include additional details. As described above, a plate of material of rough dimension (e.g., steel, aluminum, etc.) is obtained for the pallet. A desired number and pattern of the securing slots is cut out with a CNC (computer numerically controlled) Plasma Table/Waterjet/Laser/mill (for example, as described above with regard to FIG. 1), and then the plate of material is cut to the exact dimensions required (for example, 40" by 48" for the pallet 100). A square stock for the support legs is then cut out. A square stock for the center support leg (slightly longer than the other support legs to accommodate the thickness of a bar stock that will be used to form the base structure) is cut out. The bar stock (e.g., a ¼" thick bar stock) is cut in lengths to link all of the peripheral support legs together once welded. The peripheral support legs are placed at the edges of the pallet and joined to the pallet via one or more processes including SMAW (Stick Welding), GTAW (TIG Welding), FCAW (MIG Welding), ultrasonic joining, chemical adhesion, or another joining process. The center-point support leg is placed at the center of the pallet and joined via the above-mentioned methods to the pallet.

The pallet is then placed in a jig and/or a clamp so that the top plate of the pallet is facing down and the support legs are oriented upright. The bar stock is placed between the top plate and the welding table (or fixture) so that the corners of the top plate slightly bow upwards (e.g., by approximately ¼" at each corner) towards the center-point support leg of the pallet. Once the pallet is bowed, the pallet is clamped thoroughly, and then the bar stock is joined via the above-mentioned methods to the peripheral support legs and the center-point support leg. The pallet is removed from the fixture and allowed to relax. The tension created by forcefully deforming the pallet at each corner creates a slight prestress in the pallet which prevents it from deforming under extreme loads. For example, the pallet manufactured using the process 500 can withstand loads of up to about 25 tons. A primer and paint or other corrosion resistant or protective coating may then be applied to all or a portion of the pallet as desired.

Figure 7A:
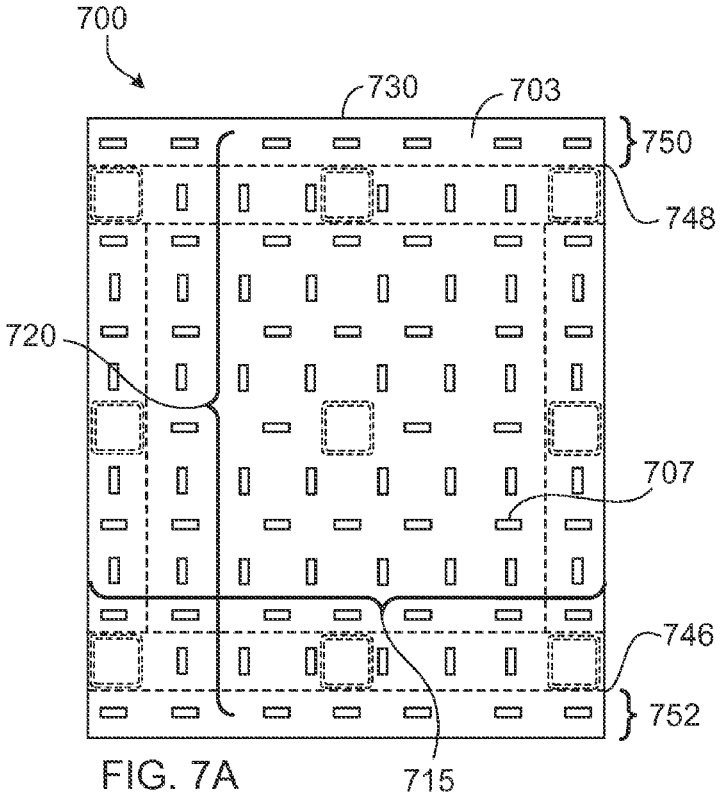
FIG. 7A is a top view of a second implementation of a pallet.

FIG. 7A is a top view of a second implementation of a pallet. The pallet 700 may include one or more or all of the features of the pallet 100 described above. In addition, the pallet 700 includes extended edges 750 and 752 that facilitate lifting the loaded or unloaded pallet, as described below. The pallet 700 includes a rectangular top plate 703. The rectangular top plate 703 can span substantially 40 inches in one dimension and 48 inches in the other dimension. Alternatively, the top plate 703 can have approximate dimensions of 48 inches×48 inches, 60 inches×36 inches, 36 inches×36 inches, 24 inches×24 inches, or other dimensions. The top plate 703 can include multiple securing slots 707, each of which has a length dimension that is greater than a width dimension. For example, the top plate 703 can have eighty securing slots 707, each of which has a length dimension of about 2 inches and a way to dimension of about 0.5 inches. Similar to the securing slots of the pallet 100, the securing slots 707 can be appropriately sized and shaped to receive and accommodate mechanisms that may be used to secure loads to the pallet 700. For example, either or both of securing bolts and/or the majority of metal and plastic strapping and banding material of different thicknesses (e.g., ½", ⅝", ¾", 1", 1¼", 1½", 2", or other thickness). The slots 707 can be arranged in orientations that baby from each other. For example, a first subset of slots (e.g., 48 slots) can be oriented such that each slot's lengthwise direction is perpendicular to an orientation of a second subset of slots (e.g., 32 slots). More specifically, in this example, the top plate 703 has seven rows 720 of securing slots 707. Each row has seven slots; the rows are 5 inches apart. The slots in the seven rows 720 lengthwise parallel to an edge 730 of the top plate 703. In addition, the top plate 703 has seven columns 715 of securing slots 707. Some columns have four slots while others have six slots. The columns are 5 inches apart. The slots 707 in each column are lengthwise perpendicular to the edge 730 of the top plate 703.

Figure 7C:
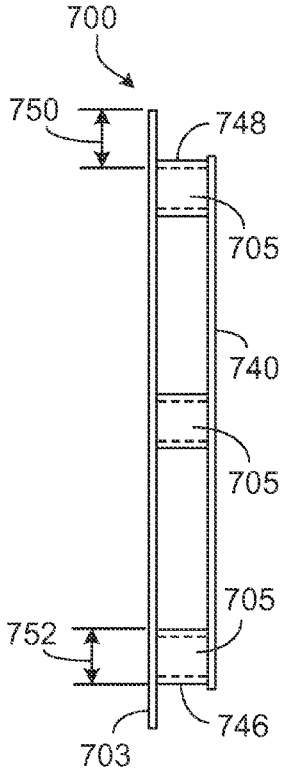
FIG. 7C is a right side view of the pallet of 7A.
Figure 7B:
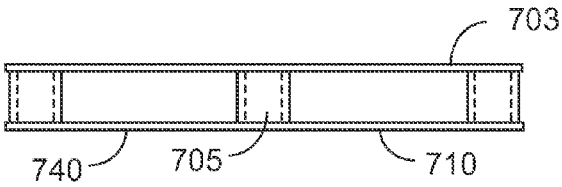
FIG. 7B is a front view of the pallet of FIG. 7A.

FIG. 7B is a front view of the pallet of FIG. 7A. The top plate 703 of the pallet 700 is spaced apart from a base structure 740. The base structure 740 can be either a complete plate or a plate having a central void (i.e., a hole in the middle of the plate). The top plate 703 is spaced apart from the base structure 740 by support legs 705, each of which is attached to the top plate 703 at one end and to the base structure 740 at an opposite end. In some implementations, the support legs 705 can be formed as square posts. Alternatively, or in addition, the support legs 705 can be formed of other shapes, e.g., cylindrical, rectangular, triangular, or other shapes. The pallet 700 can include eight peripheral support legs 705 (one in each corner of the pallet 701 at each midpoint of the edges). A different number of support legs 705 could be used. Additionally, the pallet 700 includes a center-point support leg (not shown) that extends downward from the center of the top plate 703. In some implementations, the support legs 705 can be 5 inches tall or be of other height.

Figure 7D:
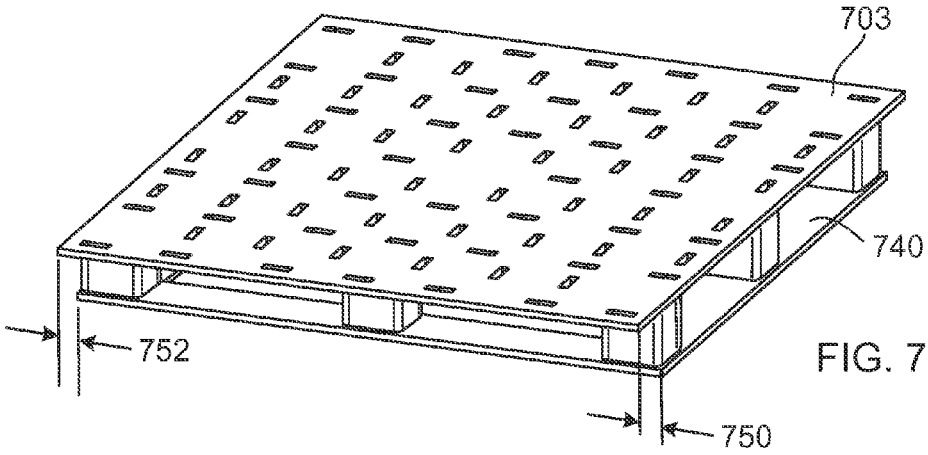
FIG. 7D is an isometric view of the pallet of FIG. 7A.

FIG. 7C is a right side view of the pallet of FIG. 7A. In some implementations, the edges of the top plate 703 can extend beyond the edges of the base structure 740. For example, the edges of the base structure 740 defined by a first edge 746 of a support leg 705 and a second edge 748 of another support leg 705. A first portion 752 of the top plate 703 can extend beyond the first edge 746. Similarly, a second portion 750 of the top plate 703 can extend beyond the second edge 748. In some implementations, a row of securing slots 707 can be formed on each portion of the top plate 703 that extends beyond the edges of the base structure 740. In other implementations, the extended portion of the top plate 703 can be void of any securing slots. In some implementations, the top plate 703 can be extended in a direction perpendicular to the edge 730 of the top plate 703 as shown in FIGS. 7A and 7C. Alternatively or in addition, the top plate 703 can be extended in a direction parallel to the edge 730. FIG. 7D is an isometric view of the pallet of FIG. 7A showing the top plate 703 extending beyond the edges of the base structure 740. In some implementations, each of the portion 750 and 752 can extend 5 inches (or other distance) beyond the edge 748 and 746, respectively, off the base structure 740.

Because at least a pair of edges of the top plate 703 extend beyond a pair of edges of the base structure 740, a surface area of the top plate 703 is greater than a surface area occupied by the base structure 740. Extending the top plate 703 as described above can facilitate attaching lifting mechanisms, e.g., spreader bars implemented by cranes to lift items such as the pallet 700. The spreader bars can be positioned under the extended portions of the top plate 703. When the pallet 700 is lifted off the ground, the weight of the spreader bars forces them towards each other, thereby securing a fit of the spreader bars to the pallet 700.

Particular embodiments of the subject matter have been described. Other embodiments are within the scope of the following claims. For example, the actions recited in certain claims can be performed in a different order and still achieve desirable results. As one example, the processes depicted in the accompanying figures do not necessarily require the particular order shown, or sequential order, to achieve desirable results.

What is claimed is:

1. A pallet comprising:

a top plate defining a first surface area;

a base structure spaced apart from the top plate defining a second surface area that is less than the first surface area, wherein a pair of edges of the top plate extend beyond a pair of edges of the base structure that are parallel to the pair of edges of the top plate, the pair of edges of the top plate defining an extended portion of the top plate, the extended portion configured to attach to lifting mechanisms to lift the pallet; and a plurality of support legs that are attached to the top plate at respective first ends, at least a portion of the plurality of support legs being attached to the base structure at respective second ends, the plurality of support legs being disposed between the top plate and the base structure in an arrangement that accommodates engagement of the pallet with a standard jacking device; wherein the top plate defines a plurality of securing slots extending through the top plate wherein the extended portion includes at least one of the plurality of securing slots, wherein a first subset of the plurality of securing slots is oriented lengthwise parallel to a first edge of the top plate and a second subset of the plurality of securing slots is oriented lengthwise perpendicular to the first edge of the top plate.

2. The pallet of claim 1, wherein the pallet comprises at least one of steel and aluminum.

3. The pallet of claim 1, wherein the top plate is rectangular in shape with approximate dimensions of one of the following: 48 inches by 40 inches, 48 inches by 48 inches, 60 inches by 36 inches, 36 inches by 36 inches, and 24 inches by 24 inches.

4. The pallet of claim 1, wherein the base structure comprises a rectangular plate defining a central void.

5. The pallet of claim 1, wherein the plurality of support legs comprises nine posts.

6. The pallet of claim 5, wherein more than one but fewer than all of the posts join the base structure to the top plate.

7. The pallet of claim 5, wherein four of the nine posts are disposed near respective corners of the top plate and another four of the nine posts are disposed near midpoints of respective edges of the top plate.

8. The pallet of claim 5, wherein at least one of the nine posts is affixed to the top plate and extends into a central void defined by the base structure.

9. The pallet of claim 1, wherein each of the plurality of securing slots has a length that is greater than a width of the respective securing slot.

10. The pallet of claim 9, wherein each of the plurality of securing slots is rectangular in shape, having a length dimension of about two inches and a width dimension of about 0.5 inch.

11. The pallet of claim 1, wherein the first subset of the plurality of securing slots comprises at least eight rows of securing slots evenly spaced across the top plate.

12. The pallet of claim 11, wherein the second subset of the plurality of securing slots comprises at least seven rows of securing slots evenly spaced across the top plate.

13. The pallet of claim 12, wherein the second subset of the plurality of securing slots is oriented perpendicular to the first subset of the securing slots.

14. A method of manufacturing a pallet, the method comprising:

forming a top plate defining a first surface area and a plurality of securing slots, wherein a first subset of the plurality of securing slots is oriented lengthwise parallel to a first edge of the top plate and a second subset of the plurality of securing slots is oriented lengthwise perpendicular to the first edge of the top plate; and joining the top plate with a base structure defining a second surface area that is less than the first surface area via a plurality of support legs, the plurality of support legs being disposed between the top plate and the base structure in an arrangement that accommodates engagement of the pallet with a standard jacking device, wherein a pair of edges of the top plate extend beyond a pair of edges of the base structure that are parallel to the pair of edges of the top plate, the pair of edges of the top plate defining an extended portion of the top plate, the extended portion configured to attach to lifting mechanisms to lift the pallet wherein the extended portion includes at least one of the plurality of securing slots.

15. The method of claim 14, wherein four of the plurality of support legs are disposed near respective corners of the top plate and another four of the plurality of support legs are disposed near midpoints of respective edges of the top plate.

16. The method of claim 14, further comprising joining a central support leg to the top plate such that the central support leg extends downward from the top plate and through a central void defined by the base structure.

17. The method of claim 14, wherein the base structure defines a central void.

18. The method of claim 14, wherein each of the plurality of securing slots has a length that is greater than a width of the respective securing slot.

19. The method of claim 14, further comprising forming a pair of edges of the top plate to extend beyond a pair of edges of the base structure that are parallel to the pair of edges of the top plate, the pair of edges of the top plate defining an extended portion of the top plate, the extended portion configured to attach to lifting mechanisms to lift the pallet.

* * * * *